US007681885B2

(12) United States Patent
Breese

(10) Patent No.: US 7,681,885 B2
(45) Date of Patent: Mar. 23, 2010

(54) CARD GAME

(76) Inventor: David L. Breese, 400 Joyce Dr., Glen Burnie, MD (US) 21061

( * ) Notice: Subject to any disclaimer, the term of this patent is extended or adjusted under 35 U.S.C. 154(b) by 284 days.

(21) Appl. No.: 11/805,928

(22) Filed: May 25, 2007

(65) Prior Publication Data

US 2008/0001359 A1 Jan. 3, 2008

Related U.S. Application Data

(60) Provisional application No. 60/809,321, filed on May 30, 2006.

(51) Int. Cl.
*A63F 1/00* (2006.01)

(52) U.S. Cl. ..... 273/292

(58) Field of Classification Search ..... 273/292
See application file for complete search history.

(56) References Cited

U.S. PATENT DOCUMENTS 5,718,430 A * 2/1998 Aramapakul et al. ..... 273/292
6,062,565 A * 5/2000 Chadband et al. ..... 273/292
6,651,984 B1 * 11/2003 Luken ..... 273/292
6,773,012 B1 * 8/2004 French ..... 273/292
7,243,919 B2 * 7/2007 Ringuette ..... 273/299
7,401,784 B2 * 7/2008 Lean et al. ..... 273/292

* cited by examiner

*Primary Examiner*—Gene Kim
*Assistant Examiner*—Dolores Collins
(74) *Attorney, Agent, or Firm*—Raymond M. Galasso; Galasso & Associates, L.P.

(57) ABSTRACT

A card game that includes a first deck and a second deck of standard playing cards, a hat and a game board to facilitate playing of the card game. The first deck includes a complete set of fifty two standard playing cards and are utilized to facilitate a first round of play comprising of a plurality hand. The second deck is a rank establishing deck and is utilized to establish each players rank prior to the initial round of play. A hat is worn by a player subsequent to the first round of play functioning to identify the loser of the first round. A game board is further included to control the term of the game.

6 Claims, 2 Drawing Sheets

CARD GAME

PRIORITY UNDER 35 U.S.C. 119(e) & 37 C.F.R. 1.78

This nonprovisional application claims priority based upon the following prior U.S. provisional patent application entitled: Cool Breeze presents "The Drinking Game, A**hole", Application No. 60/809,321 filed May 30, 2006, in the name of David L. Breese, which is hereby incorporated by reference for all purposes.

FIELD OF THE INVENTION

The present invention relates to a game, more specifically but not by way of limitation, a game that utilizes a deck of playing cards, a rank establishing deck of cards, a hat and a game board to facilitate competition between a plurality of players.

BACKGROUND

The indulgence and participation in games has existed for centuries. Individuals have engaged in a variety of games over the centuries to stimulate competition, camaraderie and enjoyment. Many styles and types of games exist. One popular game that has remained popular is cards. A standard deck of cards consists of fifty two cards that are divided into four suits. Players utilize these cards to facilitate the playing of numerous different types of card games. While many methods of playing games utilize a deck of cards, there still exists a need for alternative card games to continue to provide entertainment for individuals engaging in card games.

Accordingly, there remains a need for a card game that provides an alternative to the existing methods of card games that currently exist.

SUMMARY OF THE INVENTION

It is the object of the present invention to provide a card game and a method of playing thereof wherein a plurality of players compete to win the right to determine the actions of another player utilizing at least one physical deck of cards.

A further object of the present invention is to provide a card game and a method of playing thereof wherein at the termination of the first round of the game one player will remain in possession of at least one playing card.

Another object of the present invention is to provide a card game and a method of playing thereof wherein the last player being in possession of playing cards at the termination of the first round will be required to wear a hat.

An additional object of the present invention is to provide a card game and a method of playing thereof that will further incorporate a game board.

It is a another object of the present invention to provide a card game that further incorporates a second round of play wherein all players not wearing the hat from the first round utilize the deck of cards to control the actions of the player wearing the hat.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
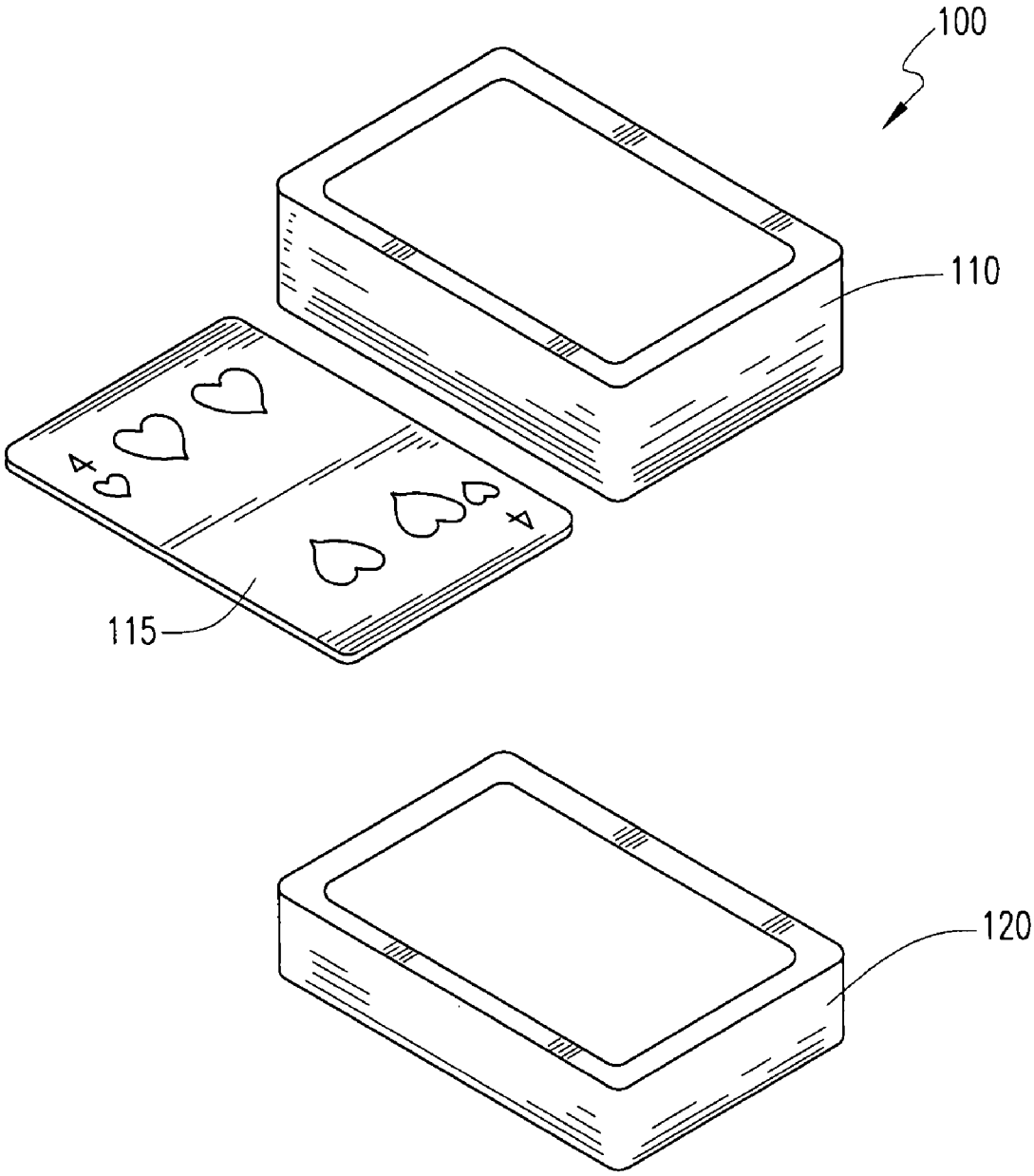
FIG. 1 illustrates an exemplary embodiment of the decks of cards to be utilized in playing the present invention.
Figure 2:
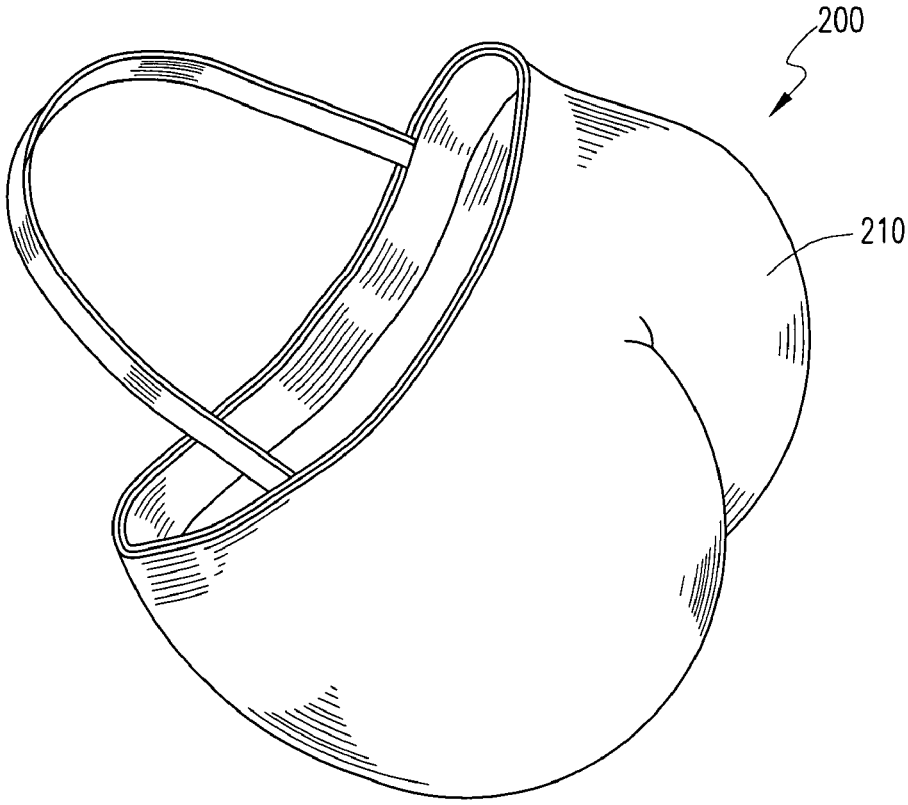
FIG. 2 illustrates an exemplary embodiment of a hat that is utilized during the play of the present invention.
Figure 3:
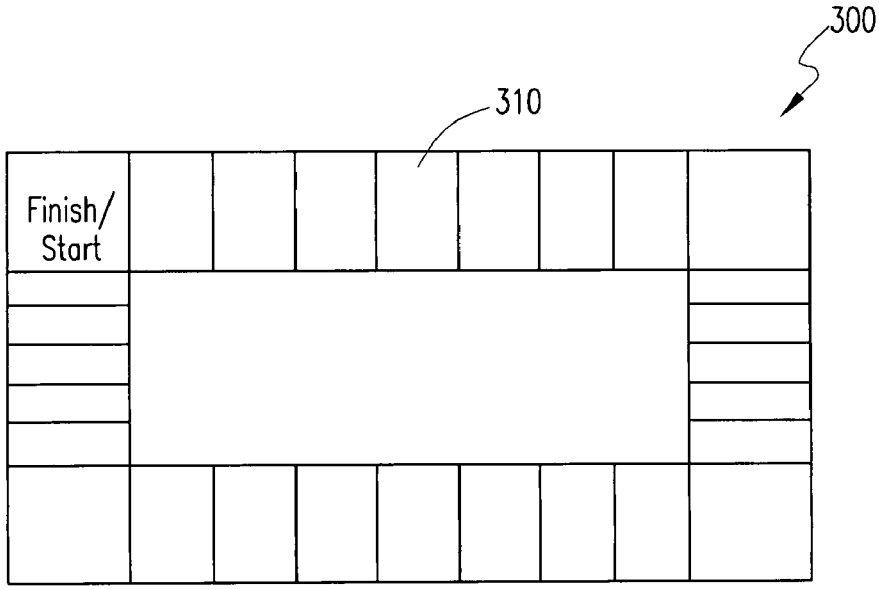
FIG. 3 illustrates an embodiment of a game board that is utilized during the play of the present invention.

Referring now to the drawing submitted herewith wherein the various elements depicted therein are not necessarily drawn to scale and in particular FIGS. 1-3, there is illustrated a preferred embodiment of a card game 100 constructed according to the principles of the present invention.

The card game 100 comprises a first deck of cards 110. The first deck of cards 110 include a traditional set of cards that have four suits, clubs, spades, diamonds and hearts with numerical values of two through ten and face cards consisting of ace, jack, queen, king. The first deck of cards 110 are completely dealt to the players engaged in the card game 100. Although no particular amount of players are required, good results have been achieved utilizing approximately three to ten players to play the card game 100. Subsequent to the dealing of the cards 115 contained within the first deck of cards 110, the players engage in the first round of play. Each player's objective is to discard all of their cards prior to their opponents. This can be accomplished by engaging in numerous varieties of card value games. Although good results have been achieved utilizing a traditional set of 4 suited cards, it is contemplated to be within the scope of this invention that virtually any type of cards establishing a type of rank, value or order could be utilized.

More specifically but not by way of limitation, the players can display one card 115 at a time and the player displaying the card 115 with the lowest value, numeric or other, would lose the hand subsequently required to maintain possession of all of the card 115 displayed in that hand while the other player have won the right to discard the cards 115 displayed by them during the hand. In this example, an ace card would have higher value than a king which would have a higher value than a queen which would have a higher value than a jack. Cards 115 of higher numeric value win over cards 115 having a lower numeric value. At least one round of play would exist until only one player remains with cards 115 from the first deck of cards 110 in their possession.

Those skilled in the art will recognize that numerous techniques of establishing a method of playing in the first round utilizing the first deck of cards 110 could be established. More specifically but not by way of limitation, the first round could include traditional card games such as but not limited to blackjack, five card draw, war, or seven card stud. Additionally, prior to the commencement of the first round of play the players could decide on a wild card that would have a predetermined value. It is also further contemplated within the scope of the present invention that one deck of cards 115 could be provided to facilitate the playing of the card game 100.

Subsequent to the first round of play a single player remains in possession of at least one of the cards 115 from the first deck of cards 110. The player remaining in possession of at least one card 115 from the first round of play is subsequently required to be identified by wearing a hat 200. While no particular type of hat 200 is required, it is desired within the scope of the present invention that the hat 200 have at least a portion 210 that resembles the human buttocks. The player who is wearing the hat 200 must continue to wear the hat 200 during the second round of play. During the second round of play the player identified by wearing the hat 200 is submissive to the other player's requests. More specifically but not by way of limitation, during the second round of play the players not wearing the hat 200 utilize the second deck of cards 120 to determine which of the players not wearing the hat 200 will require the player wearing the hat 200 to be submissive to the their request ensuing to winning a hand of play during the second round of play of the card game 100.

The second deck of cards 120 are the rank establishing cards, and are utilized to establish an initial ranking before the first round of play by having each player chose a card from the deck 120. It is contemplated that each of the cards in deck 120 have either a value or picture such that an established rank from high to low can be established for each of the players prior to the first hand.

It is further contemplated within the scope of the present invention that a board 300 could be utilized to facilitate the playing of the card game 100. More specifically but not by way of limitation, the board 300 could be utilized to determine the term of the game utilizing the spaces 310 to identify a start and a finish. Additionally, the spaces 310 could have instructions printed thereon for the player wearing the hat 200 to follow during the second round of play.

An example of a preferred embodiment of the present invention will now be described. The object of the game is for each round, each player to get rid of all of their cards, with the rank of each individual determined by the order in which they get rid of their cards. Each player will then move a predetermined number of spaces on the game board base upon their rank. The winner of the game is the first person to move around the board from the start to the finish. The game is played with a standard deck of playing cards, while a rank establishing deck of cards is utilized before the first round to establish each players initial ranking.

The rankings will depend upon the number of players.

For three players, there is the following starting with the highest rank: 1. President; 2. Beer Bitch; and 3. Asshole For 4 players, there is the following starding with the higest rank: 1. President; 2. Vice President; 3. Beer Bitch; and 4. Asshole.

For 5 players, there is the following starting with the highest rank: 1. President; 2. Vice President; 3. Cabinet Member; 4. Beer Bitch; and 5. Asshole. If there are more than 5 players, the number of Cabinet Members is increased accordingly. If more than 1 Cabinet Members are utilized, each Cabinet Member's Rank is determined by their order of getting rid of their cards.

Although good results have been achieved utilizing a number of players between 3 and 10 (inclusive), it is contemplated to be within the scope of this invention that more than 10 players could play, however a second deck of playing cards may be needed.

The number of spaces each rank is required to move is as follows: President—4 spaces; Vice President—3 spaces; each Cabinet Member—2 spaces; Beer Bitch—1 space; and the Asshole—0 spaces.

The rank of the cards are from highest to lowest, Ace, King, Queen, Jack, 10, 9, 8, 7, 6, 5, 4, 3, with the 2 being a power card, whereby the hand is over, and all the cards are cleared. Good results have also been achieved utilizing the Jokers, and/or the three's as wild cards.

To start the first round, the initial rank of each player will be determined by each player selecting one of the plurality of cards from the rank establishing deck of cards, with each rank represented by a single card. Accordingly, the rank of each player determines the seating order. The President with choose their seat, with the next rank seated to the President's left, with each decreasing rank being seated in a clockwise order there from, such that the lowest rank player, i.e. the Asshole, is sitting the to right of the President.

Additionally, each player, in highest to lowest rank order, gets to choose their particular game piece.

When dealing the cards, the lowest rank player is always the dealer. The dealer will deal to themselves first, and continue dealing in a clockwise manner. Although it is contemplated that the number of cards used can vary, when playing with 3 or 4 players, good results have been achieved by dealing out 9 cards to each player. When playing with 5 or more players, good results have been achieved by dealing out all the cards. When dealing out all the cards, the dealer always takes the last card, regardless of which player would normally be given the card in the normal course of dealing the cards. The dealer is immune from receiving any orders from other players during the dealing process.

In this embodiment, the roles of each of the ranks of players are as follows: The President, can make any other player drink at any time and can make any other player get a beer or other beverage for them. The only exception for the President is when the lowest rank player is dealing, the dealer is immune from request for performance. The President is immune from request for performance from all other players. The President has the option to alter certain rules before each hand dealt. Before the start of each hand, the President can also take the two best cards from the lowest ranked player, and give the lowest rank player any two of the President's cards. The President also starts the first hand of each new round.

The Vice President (VP) can make any other player drink at any time, with the exception of President at all times, and the dealer during dealing. At the start of each hand the VP make take 1 card from the Beer Bitch, and give any card in return. It is further the responsibility of the VP to ensure that the game is progressing in a continuous and smooth manner.

Each of the Cabinet Members can make any lower ranked player, including lower ranked Cabinet Members, drink at any time, with the exception of the dealer during dealing.

The Beer Bitch, can only make the lowest rank player, i.e. the Asshole, drink, but has the responsibility to serve all other players their beers when needed.

The lowest ranked player, i.e. the Asshole, is in charge of dealing the cards each hand, and retrieving all cards played in each hand. The Asshole cannot make any other player drink, and must perform per any players request, with the exception of when dealing the card.

To play the game, as described above, before each round, the President can pick and choose certain rules to be in effect for that particular round. These rules are described herein below. Once the card are dealt, the Asshole must give their two best cards to the President in exchange for two cards from the President. The Beer Bitch must also give their single best card to the VP in exchange for a single card from the VP. If during play, either the Beer Bitch or the Asshole are caught by other having not given their highest card(s) accordingly, they are automatically the Asshole for the next round of play.

Before each hand starts, a toast should made by player to the President. If no toast is offered, the President can hand out a "punishment" of their liking.

For the start of the first hand of the round, the President will play the first card of the hand. Once the first card is played, the order of play is the descending rank of the remaining players. For example, the VP will play the second card. Each player's turn have the option to play a higher card that the previous card, or a matching card. If a higher card is played, the play continues on to the next player. If the card matches the previous card, the next player is skipped, and that player must drink. If the current player does not have a higher card than the most recent played card, that player does not get to play a card, i.e. that player passes, however that player must drink. A hand ends when any player throws a "2" card, or when all players pass. The last person to play a card starts the next hand. During the hands, the rank order for the next round is established by the order the players get ride of all their cards. Once a player gets rid of all of their cards, they are finished for the round. The Asshole for the next round, is the last player to have cards remaining. When the round ends, the rankings for the next round have been established, and each player moves their piece around the board the number of spaces corresponding to their new rank.

The game is finished when the first player successfully traverses the game board from start to finish.

An example of rules that are selectable by the President before each round include but are not limited to: doubles on singles—where any two cards of the same value, i.e. a pair, beats any single card played; 3's and/or Jokers are wild—can be used as any card, except a 2 card, and when played the value of the wild card must be given by the player; Card Giveaway—when a player's hand contains only 2s and wild cards, on the next turn of that player, they my give all remaining cards away at once, and go out; Jumping Socials—occur when three of the same card are played consecutively, any player (in or out of turn) my play the fourth card of that, whereby all players must drink i.e. a social drink, and the hand finishes, whereby all cards are cleared and a new hand started; The 69 Rule—a player holding a 6 and a 9 card can play both cards at the same time, having the result of completing the hand, with the 6 and 9 combination being playable on anything; and Last Card Rule—whenever a player is down to their last card, they must call out "Last Card" prior to the next player playing their card, else, if another player identifies that "Last Card" has not been called out, the player with one card is either give another card, or made Asshole for the next round.

It is further contemplated that the present invention not be limited to a drinking gamer, rather could also be played as a "strip" game, whereby players are required to strip off articles of clothing rather that drink. Good results have been achieved playing a strip version as follows:

Before playing strip asshole you must first choose the clothing stakes for each round of play. As not everyone is willing to get totally naked, a vote can be taken to determine how much removal of clothing is required to end of the game. The totally nude version consists of every player only having 3 articles of clothing to remove therefore the ladies must remove their bras and panties together as last article to make it fair for the guys considering most men do not wear such clothing. The President will choose the version or rules of the game after drawing the "who da asshole" cards. The President may choose from the versions listed below The version of the game may be played in 5 different ways, with the playing of the actual game similar to the drinking version.

1. At the end of each round the asshole is the only player to remove one article of clothing. 2. At the end pf each round the asshole and the beer bitch are the only two players to remove one article of clothing. 3. At the end of each round the asshole removes two articles of clothing and the beer bitch removes one. 4. At the end of each round every player except the President and the vice president lose one article of clothing. 5. At the end of each round every player but the President loses one article of clothing and the Asshole loses two.

In the preceding detailed description, reference has been made to the accompanying drawing that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A method of playing a card game comprising:

providing at least one physical deck of cards to a plurality of players;

establishing a rank order for the plurality of players;

each of the plurality of players selecting a game piece, in their order of rank, from highest to lowest;

seating each of the plurality of players in a circle in decreasing rank order with the lowest ranked player sitting to the right of the highest ranked player;

dealing a preselected number of cards from the at least one deck of cards to each of the plurality of players;

starting a hand by a first player playing a first card;

moving in a clockwise order, the next player making a play pursuant to the following rules: playing a card if they have a card of equal or greater value than the previously played card, such that if the card is equal in value to the previously played card, the subsequent next player is skipped and the subsequent second next player takes their turn; if the next player plays a card of greater value that the previously played card, the subsequent next player is next to play a card; if the next player does not have a card of equal or great value than the previously played card, the next ranked player does not play a card, and is required to perform a first predetermined task; and continuing the hand to the next player pursuant to the rules of the step of moving in a clockwise order player and making a play until a player either plays a card of a preselected value, or until a player has played all their cards.

2. The method of playing a card game as recited in claim 1, further comprising the step of requiring the subsequent next player to perform a second predetermined task if the next player plays a card of equal value to the previously played card.

3. The method of playing a card game as recited in claim 2, wherein said step of establishing a rank order includes the step of each of the plurality of players selecting a card from the at least one deck, wherein the rank order is determined by the value of the selected cards.

4. The method of playing a card game as recited in claim 3, wherein the plurality of players is at least 3 players.

5. The method of playing a card game as recited in claim 4, wherein the first predetermined task is drinking an alcoholic beverage.

6. The method of playing a card game as recited in claim 5, wherein the second predetermined task is drinking an alcoholic beverage.

* * * * *